US006082055A

United States Patent [19]

Kelly

[11] Patent Number: 6,082,055

[45] Date of Patent: Jul. 4, 2000

[54] ICE RINK COVER

[75] Inventor: L. Patrick Kelly, Lake Placid, N.Y.

[73] Assignee: Irum Ice, Inc., Lake Placid, N.Y.

[21] Appl. No.: 09/134,721

[22] Filed: Aug. 14, 1998

Related U.S. Application Data

[60] Provisional application No. 60/055,612, Aug. 14, 1997.

[51] Int. Cl.[7] ..... A63C 19/12

[52] U.S. Cl. ..... 52/71; 52/3; 52/5; 52/22; 52/39; 52/66; 52/69; 52/83; 52/506.02; 220/218; 62/235

[58] Field of Search ..... 52/3, 5, 22, 29, 52/32, 39, 66, 69, 71, 83, 506.02; 150/901, 154; 220/218; 108/166; 62/235; 4/498, 500

[56] References Cited

U.S. PATENT DOCUMENTS

| | | | |
|---|---|---|---|
| 522,120 | 6/1894 | McHarry | 52/66 |
| 992,818 | 5/1911 | Speck | 52/3 |
| 1,167,871 | 1/1916 | Adams | 52/3 |
| 1,275,148 | 8/1918 | Friedlein | 52/3 |
| 1,564,085 | 12/1925 | McMillan | 52/3 |
| 2,942,658 | 6/1960 | Wilson | 52/66 X |
| 2,990,556 | 7/1961 | Bender | 4/500 |
| 3,405,410 | 10/1968 | Oldshue | 4/498 |
| 3,870,587 | 3/1975 | Merrell | 52/177 X |
| 3,983,713 | 10/1976 | MacCracken | 62/235 X |
| 4,006,567 | 2/1977 | Flannery | 52/29 X |
| 4,281,802 | 8/1981 | Burley . | |
| 4,426,744 | 1/1984 | Love | 4/500 X |
| 4,598,506 | 7/1986 | Nohl et al. | 4/498 X |
| 4,632,329 | 12/1986 | Burley . | |
| 4,728,536 | 3/1988 | Burley et al. . | |
| 4,959,942 | 10/1990 | Olewska | 52/29 X |
| 5,067,182 | 11/1991 | Koelsch | 4/498 |

FOREIGN PATENT DOCUMENTS

| | | | |
|---|---|---|---|
| 3240830 | 5/1984 | Germany | 52/5 |

*Primary Examiner*—Laura A. Callo

*Attorney, Agent, or Firm*—Connolly Bove Lode & Hutz LLP

[57] ABSTRACT

An ice rink covering system utilizes a plurality of support mechanisms for sets of non-flexible insulated panels which are interconnected by a hinge mechanism between each pair of adjacent panels. The support mechanisms are connected to the panels by lifting units for selectively moving the panels in an accordion fashion for either edge to edge contact when the panels cover a rink or side to side contact when the panels are in their stored condition.

29 Claims, 5 Drawing Sheets

25
22
22A
23
24
26
27
28
29
30
31
32
33
34
46
48
56
58
60
62
64
66
68

ICE RINK COVER

CROSS-REFERENCE TO RELATED APPLICATION

This application is based upon provisional application Ser. No. 60/055,612 filed Aug. 14, 1997.

BACKGROUND OF THE INVENTION

Various attempts have been made to cover ice rink surfaces, such as by the use of insulation. Reference is made to U.S. Pat. Nos. 4,728,536, 4,632,329, and 4,281,802 which describe some of those attempts. In the '536 patent, for example, use is made of a metastable liquid foam over the ice surface. In the '329 and '802 patents use is made of a flexible insulating blanket to cover the ice surface which involves a mechanism for reeling and unreeling of the device.

Among the problems that must be taken into account in designing an effective cover system is the non-standardized sizes and shapes of such ice rinks, as well as the difficulties in storing, deploying and retracting any cover system.

SUMMARY OF THE INVENTION

An object of this invention is to provide an ice rink cover system which is capable of being readily deployed and retracted.

A further object of this invention is to provide such a system which utilizes a non-flexible thermal coating on the top of the ice rink skating surfaces in their non-use phase to reduce the cost involved with mechanical refrigeration.

In accordance with this invention the ice rink cover system utilizes interconnected insulated support panels which are connected to each other by a hinge mechanism so that the panels can be moved from a surface to surface stored condition and an edge to edge covering condition by connecting the panels in an accordion fashion. The movement of the panels to and from the stored and covering positions can be effected by means of a reversible motor mounted at a convenient location with a cable/chain pulley system secured to the motor and the panels. Thus, for example, when the joints between alternate panels are lifted or raised by actuating the motor in one direction, the panels are disposed in a compact side by side position which can be elevated or otherwise moved to a convenient location which does not interfere with use of the rink. During the covering condition the direction of the motor is reversed and the panels are disposed against each other in edge to edge contact so as to cover the rink.

THE DRAWINGS

DETAILED DESCRIPTION

Figure 1:
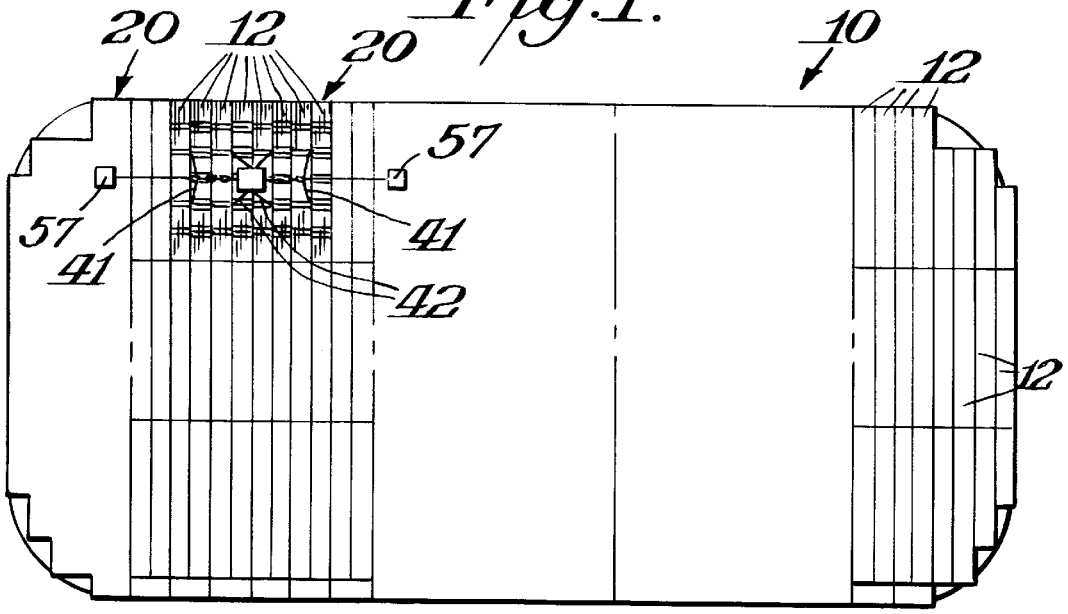
FIG. 1 is a top plan view of an ice rink cover system in accordance with this invention.

The ice rink covering system 10 of this invention provides for the deploying and retracting of a non-flexible thermal covering on top of ice rink skating surfaces in their non-use phase to reduce the cost involved with the mechanical refrigeration. As shown in the drawings the system 10 consists of a plurality of interconnected insulation support panels 12. Each panel 12 is preferably 4 foot by 24 foot by 2 inches or 1 inch non-flexible insulation 16 (FIGS. 7–10), such as commercially available polystyrene from Dow, DuPont and other companies. Insulation 16 may have a protective fabric covering or may be bare, as illustrated. The panels are connected to each other using side straps 14 which may be made, for example, any suitable material. Each strap 14 extends around its panel and around a rod 15 secured through aligned holes in interdigitated hinge structure 17 at the end of each panel. Hinge structure 17 comprises a rigid plate 19 with outwardly extending loops or sleeves 21 spaced apart so that the sleeves 21 of the adjacent panel hinge structure could fit therebetween in an interdigitating manner and be pivotally connected around pivot rod 15. Suitable materials for the straps and hinge mechanisms include nylon 6/6 and/or PVC and brass.

Figure 7:
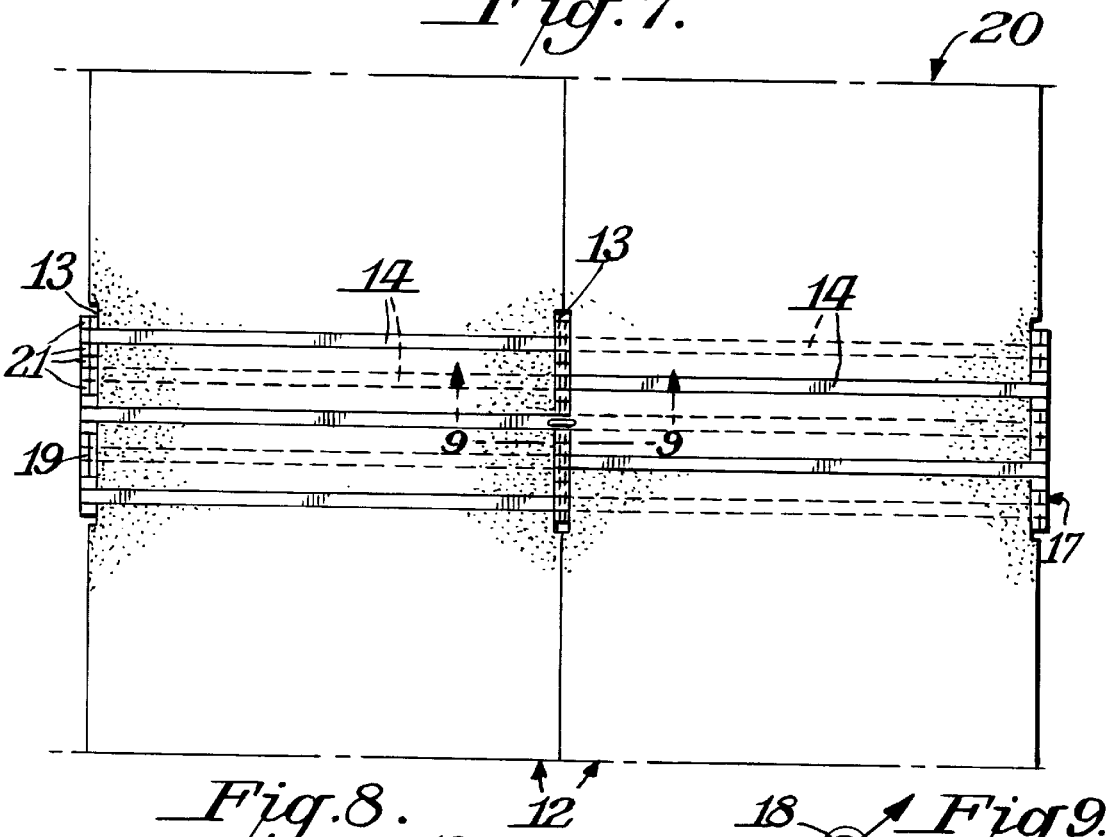
FIG. 7 is a top plan view of a pair of panels used in the system of FIGS. 1–5.
Figure 8:
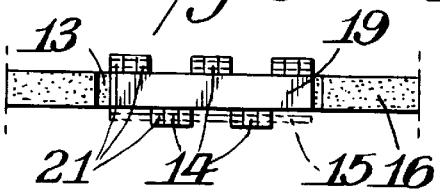
FIG. 8 is an end elevational view of one of the panels used in the system of FIGS. 1–7.

As shown in FIG. 7, the insulation panels 12 may have recesses 13 where the hinge mechanisms 17 are located so that the panels are flush with each other in the deployed or horizontal condition.

Alternatively, the insulation for each panel could be covered with a flexible fabric so that the flexible fabric at the junction of two adjacent panels forms a hinge.

Figure 2:
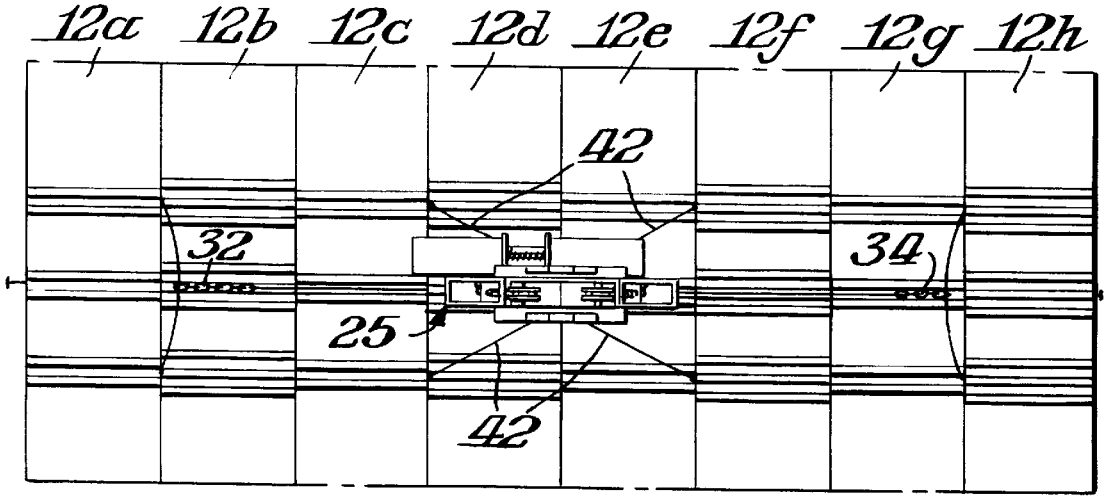
FIG. 2 is an enlarged plan view of a portion of the system shown in FIG. 1 with the panels in the covering condition.
Figure 3:
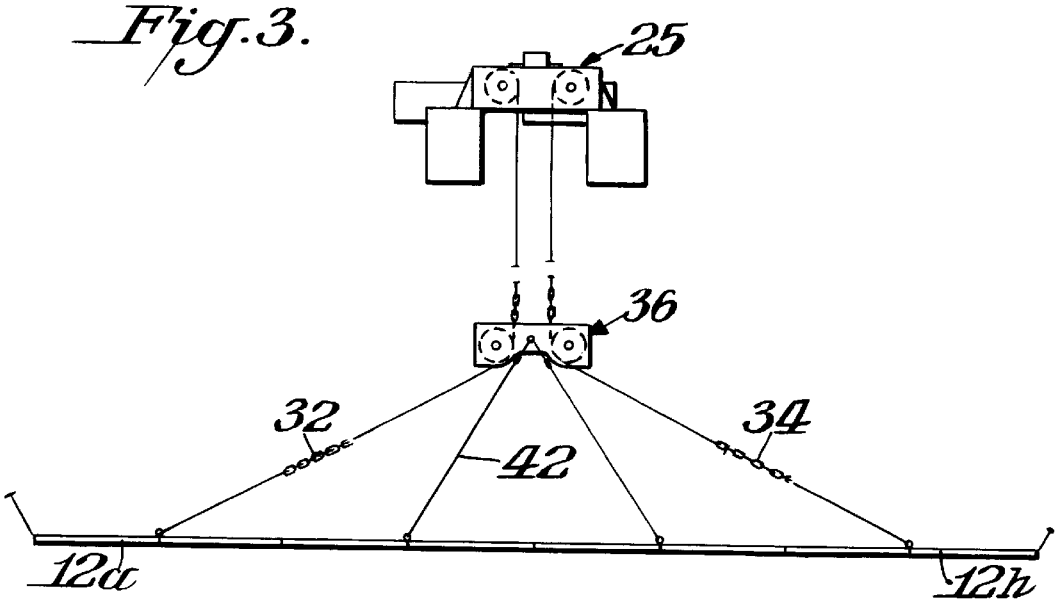
FIG. 3 is a side elevational view of the portion of the system shown in FIG. 2 with the panels in the covering position.
Figure 5:
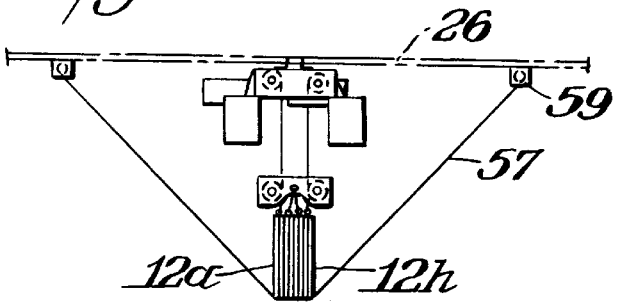
Figure 6:
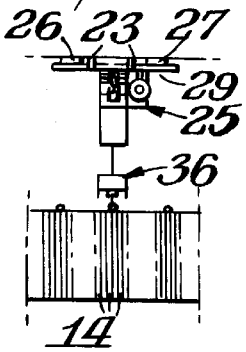
FIG. 6 is an end elevational view of the system shown in FIG. 5.

When the system is in its stored condition such as shown in FIGS. 5–6 the panels fold together in surface to surface contact, like an accordion. The panels may have rollers connected to the hinge mechanisms, if desired, such as by using rollers made of plastic or Delrin to allow the panels to easily slide along the ice during deployment and retraction. In the preferred practice of this invention, however, rollers are not necessary. Preferably, a plurality of panel sections or modules comprising rows of eight panels per row would be secured together to form a single support mechanism 20. FIG. 1, for example, illustrates a single support mechanism 20 shown with its set of panels highlighted. The left-most reference numeral 20 in FIG. 1 represents a further support mechanism. The total number of support mechanisms would depend on the total number of panels required to completely cover the ice rink. FIGS. 2–3 show a single support mechanism. It is to be understood that the invention may be practiced where some or all of the support mechanisms 20 in turn are interconnected or where they all remain separate and distinct from each other and are individually deployed in a juxtaposed manner.

The specific number of mechanisms 20 is selected to customize the system to specific ice rinks. Thus, an entire system may use a plurality of identical mechanisms 20 over the major part of the rink and customized mechanisms over the end or edge portions of the rink. Preferably, the total deployment/retraction time is less than 5 minutes and the system reduces surface heat transferred to the ice in the range of 75% to 90% depending on insulation thickness, rink design and geographical climate.

The system 10 with its support mechanisms 20 is preferably stored, deployed and retracted in such a manner as to minimize interference with use of the rink, particularly in the stored condition. The system may, for example, be deployed from a ceiling or side wall by use of cables, chains and/or ropes, pulleys and winches either mechanical or manual. Gravity, friction and spring (or potential energy mechanisms) can be utilized in the deployment/retraction of the systems. The particular ceiling or side wall storage would be dependent upon the design of the rink that uses the system.

Figures 14, 15:
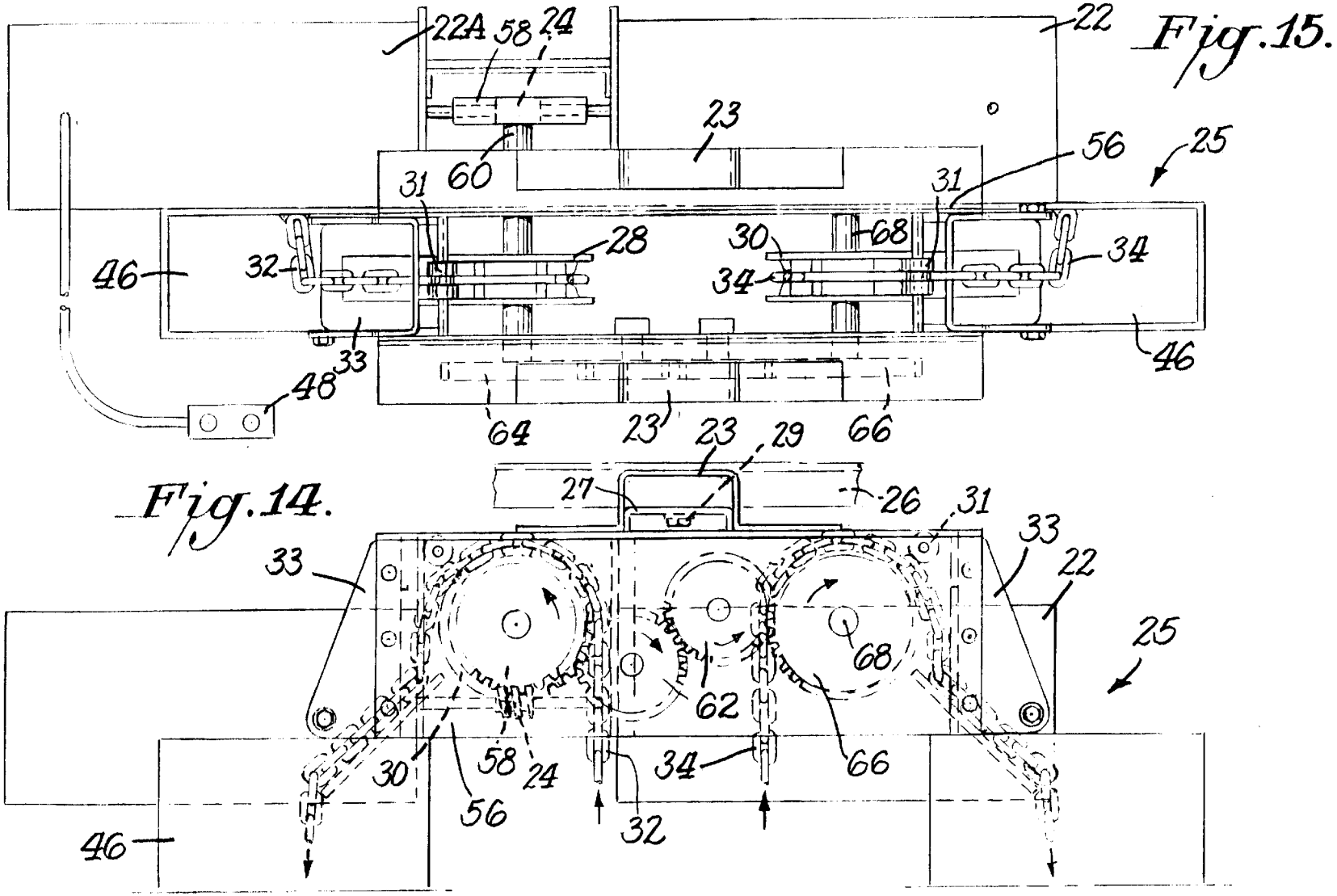
FIG. 14 is a side elevational view of the upper lift assembly used in the system shown in FIGS. 3–6.
FIG. 15 is a top plan view of the upper lift assembly shown in FIG. 14.

Preferably the mechanisms 20 are stored so that the rink lighting would not be affected. FIGS. 14–15, for example, illustrate two spaced mounting brackets 23 which connect the mechanism between corrugations of a corrugated ceiling 26. An elongated inverted U-shaped channel member 27 is inserted through the brackets 23 against the lower surface of the downwardly extending corrugations and is mounted to the corrugations at one or more spaced locations by bolts 29, as shown in FIG. 14.

In the preferred practice of the invention brackets 23 would extend across housing 56 perpendicular to the position shown in FIGS. 14–15 so as to be parallel to and fit between spaced corrugations. The corrugated ceiling 26 is mounted on top of spaced joists. The U-shaped elongated channel member 27 would be disposed 180° from the position shown in FIG. 14 and would be between and parallel to spaced brackets 23, with channel 27 resting on the spaced joists.

The drawings illustrate a preferred manner of practicing the invention for moving the panels to and from the stored or retracted condition and the deployed or covering condition. As shown therein a motor 22 is mounted at any suitable location above the rink in an upper lift assembly 25. A redundant motor 22A is provided in case primary motor 22 fails. Each motor 22 and motor 22A is a reversible motor with an elongated worm shaft 24 connected to both motors. See FIGS. 14–15. Each of the support mechanisms 20 would be provided with its own motor and lift assemblies as later described.

In general, each support mechanism 20 has an upper lift assembly 25 mounted in a fixed manner to a support such as the ceiling 26, as previously described. A pair of sprockets 28,30 is provided in upper lift assembly 25. A sprocket chain 32 is engaged with sprocket 28 while a sprocket chain 34 is engaged with sprocket 30. Rollers 31 maintain the chains engaged with their sprockets. Each sprocket is provided with a U-shaped guide chute 33 to guide the chains to lower lift unit 36.

Figure 9:
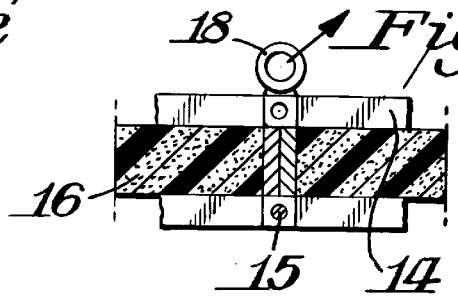
FIG. 9 is a cross-sectional view taken through FIG. 7 along the line 9—9.
Figure 10:
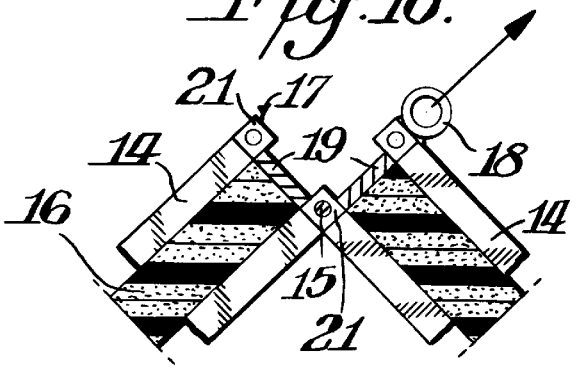
FIG. 10 is a view similar to FIG. 9 in a different stage of operation.

Lower lift unit 36 has a set of pocket wheels 38 and 40 as part of pocket wheel assemblies 37 and 39. (See FIGS. 11–13) As later described the pocket wheels 38,40 are free to rotate on their shafts 72,74. Chains 32,34 engage against pocket wheels 38,40 to raise or lower lift unit 36 in accordance with the direction of movement of the chains. Each of the chains is anchored to the hinge mechanism between a respective end pair of panels 12*a*,12*b* and 12*g*,12*h*. See FIGS. 1–3. FIGS. 1–3 show the chains 32,34 connected to the panels by means of a rope 41 which extends through a chain link with each end of the rope 41, in turn, being secured to a respective hinge mechanism. (The hinge plate 19 may be notched to accommodate rope 41.) FIGS. 7 and 9–10 illustrate an alternative arrangement of the hinge mechanisms to include a loop 18 which would be used for connecting the end of each respective chain 32,34.

Figure 11:
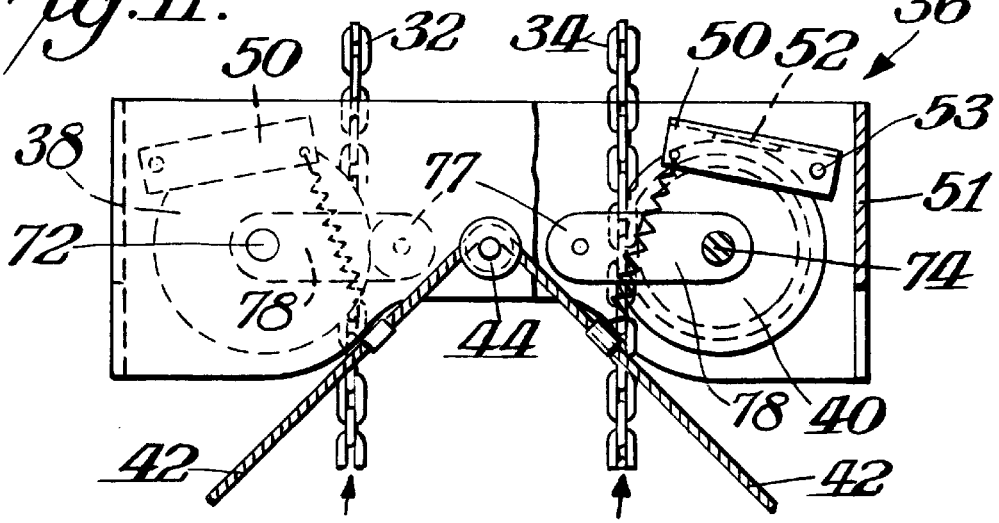
FIG. 11 is a side elevational view of the lower lift assembly shown in FIGS. 1–6.

The end pairs of panels 12*a*,12*b* and 12*g*,12*h* are thereby mounted to the lower lift unit 36 by chains 32,34. The remaining pairs of panels are mounted to the lower lift unit 36 by sets of ropes 42,42. As shown in FIGS. 2–3 the ends of each rope 42 are connected to respective hinge mechanisms of adjacent pairs of panels. One rope end would connect the adjacent pair of panels 12*c*,12*d*, while the other rope end would connect the adjacent set of panels 12*e*,12*f*. FIG. 11 illustrates one alternative where only two ropes 42 are used. As shown therein, the ropes pass over pulley 44 in lower lift unit 36. The pulleys 44 may be located either within or on the outside of the lift unit housing 51. Where the pulleys are within the housing, the ropes would pass through the open space below the housing end walls. Although the use of fibrous ropes 42,42 is preferred, the invention may be practiced with chains or other connecting members.

Figure 12:
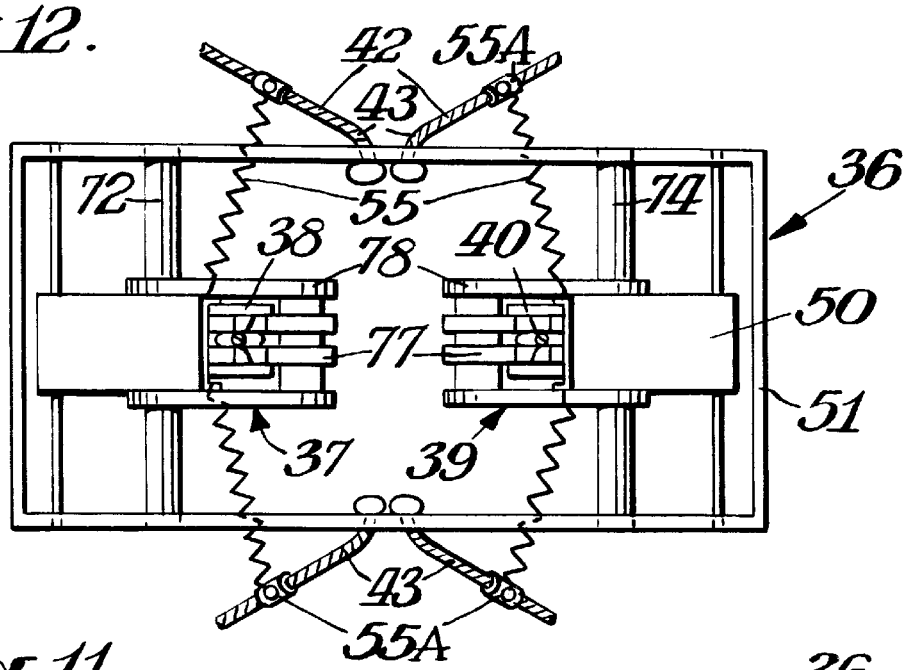
FIG. 12 is a top plan view of the lower lift assembly similar to that shown in FIG. 11.
Figure 13:
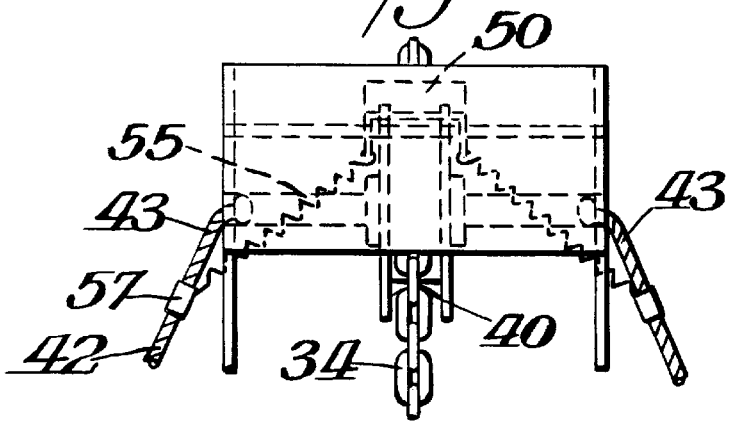
FIG. 13 is an end elevational view of the lower lift assembly shown in FIG. 12.

FIGS. 12–13 illustrate the preferred practice of the invention where four separate ropes 42 are used. Each rope 42 is anchored at one end 43 to housing 51. The opposite end of each rope is secured to the hinge mechanism of a set of adjacent panels as previously described and as shown, for example, in FIG. 3.

By connecting the various sets of adjacent panels the lowering or raising of the panels can be accomplished through the lower lift unit. When the panels are raised they assume a side by side accordion relationship such as shown in FIGS. 5–6. When the panels are lowered into contact with the ice they assume an edge to edge relationship such as shown in FIGS. 1–3.

In one practice of this invention when the panels are in the fully covered condition of FIGS. 1–3, chains 32,34 have some slack between pocket wheels 38,40 and the panels 12, while ropes 42,42 are taut. Chains 32,34 may have slack or be taut between sprockets 28,30 and pocket wheels 38,40.

Figure 4:
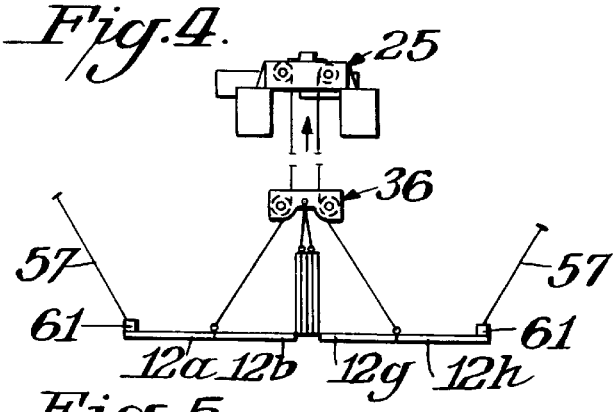
FIGS. 4–5 are side elevational views showing various stages of the panels approaching the fully uncovered condition.

In operation when the panels are moved from their fully covered condition of FIGS. 2–3 to the fully uncovered condition of FIGS. 5–6, the motor 22 would be actuated to cause the chains 32,34 to become taut between sprockets 28,30 and pocket wheels 38,40 thereby forcing the lower lift assembly to raise and cause the connector ropes 42 between the pairs of panels 12*c*,12*d* and panels 12*e*,12*f* to move upwardly so that the two pairs of intermediate panels assume the vertical condition shown in FIG. 4. The continued upward movement of the sprockets 28,30 in the upper lifting unit 25 causes the lower lifting unit 36 to be elevated by the engagement of the chains 32,34 with sprockets 38,40 continuing to raise the lower lifting unit 36. Thus, initially the support mechanism 20 moves the panels from the edge to edge position of FIG. 3 to the condition shown in FIG. 4. Ultimately, the continued operation of motor 22 causes the panels to assume a surface to surface accordion type condition shown in FIGS. 5–6.

FIGS. 14–15 show a preferred construction for the upper lift assembly 25. As shown therein the upper lift assembly 25 includes a housing 56 in which is mounted the motor 22 (and redundant motor 22A) having its worm shaft 24. Worm 24 engages a drive gear 58 having a common shaft 60 on which is mounted sprocket 28 and gear 64. Gear 64 meshes with gear train 62 which meshes with gear 66 on shaft 68 on which sprocket 30 is fixedly mounted. Thus, when motor 22 rotates its worm shaft 24, the worm shaft 24 causes drive gear 58 to rotate shaft 60 which in turn rotates pulley or sprocket 28 and through the engagement of gears 62,64,66 simultaneously rotates sprocket 30. In the preferred practice of the invention gears 64 and 66 are sufficiently large to directly mesh thereby eliminating the need for an intermediate gear train. During the upward movement of the chains 32,34 the free ends of the chains are collected in bins 46,46.

If there should be a failure of motor 22, then redundant motor 22A would become operative and would drive worm 24. The operation of the upper lift assembly may be controlled through remote control unit 48 by an operator at ground level.

FIGS. 11–13 show the details of the lower lift assembly 36, which may also be considered as an intermediate assembly in that it is disposed between the upper lift assembly 25 and the panels to control the direction of movement of the motion transmitting members such as the ropes or chains. As shown therein pocket wheel 38 is freely mounted on a fixed shaft 72, while pocket wheel 40 is freely mounted on a parallel fixed shaft 74. The pocket wheels 38,40 by their engagement with chains 32,34 cause the lower lift assembly 36 to move up or down in accordance with the direction of movement of the chains as controlled by the upper lift assembly 25.

As shown in FIGS. 11–12 chain guides or retainers 77 are provided in the lower lift assembly 36 to maintain the chains 32,34 against the pocket wheels 38,40. FIGS. 11–12 also illustrate support arms 78 which are mounted on the respective shafts 72,74 to provide a U-shaped arrangement in connection with the guides 77 for assuring that the chains are maintained engaged with the pocket wheels.

The pocket wheel assemblies 37,39 are each provided with a brake mechanism. As best shown in FIG. 11 the brake mechanism comprises a U-shaped plate 50 hinged to lower lift unit housing 51 by its shaft or pin 53. The opposite end of each plate 50 has a pair of oppositely located extension springs 55 as best shown in FIG. 12. As also shown in FIG. 12 the opposite end of each spring 55 is secured to a sleeve or collar 55A around rope 42. When the ropes 42 are pulled upwardly by the raising of the chains 32,34 there is tension on both sides of each rope thereby centering the rope about pulley 44. The tension from raising the ropes 42 results in a downward pull on the springs 55 to thereby cause a brake pad 52 on plate 50 to make contact with the pocket wheels 38,40 so that the brakes act like a clutch to prevent a free spinning of the pocket wheels. As a result, the friction from the brakes provides stability. If there are any inefficiencies in the lower lift unit, the brakes compensate for such inefficiencies and assure proper upward movement. Thus, the brakes are activated when there is tension on the ropes 42 during the raising of lower lift unit 36 but there is no tension during the lowering of the lower lift unit so that the pocket wheels are free spinning under the lowering conditions.

During the lowering of the panels from the condition shown in FIGS. 5–6 to the condition shown in FIGS. 2–3 the following steps take place. Motor 22 is activated to rotate its worm 24 and move chains 32,34 in a downward direction, there being an ample length of chain present in collection boxes 46,46. The lower lift unit 36 then moves downwardly and the downward movement of the chains 32,34 permits the end sets of panels to rotate from their vertical condition to the horizontal condition shown in FIG. 4. The remaining intermediate panels are kept in their vertical condition by ropes 42. As the lowering of lower lift unit 36 continues the panels make contact with the ice. Continued downward movement would permit the intermediate vertical panels to then slide outwardly and assume a horizontal position. Where the hinges of the panels are provided with rollers the sliding movement would be facilitated.

If desired, the outward spreading of the panels can be facilitated by cables connected to the outermost panels 12*a* and 12*h*, as best shown in FIGS. 4–5. As shown therein, cables 57,57 are each connected to a spring loaded reel 59 at an obtuse angle. Tensioning the cables 57 causes the end panels 12*a*,12*h* to move outwardly thereby facilitating the intermediate panels to assume a horizontal condition so that the entire group of panels is in the edge to edge condition shown in FIGS. 1–3. When in the horizontal position there could be slack in cables 57—57 so that the end panels are not being raised above the ice.

FIG. 4 illustrates a weight 61 at the end of each cable 57 where it is secured to respective end panels 12*a* and 12*h* to assure maintaining the end panels in a horizontal orientation. The specific weights could vary in accordance with particular mechanisms.

The cables 57,57 could be mounted to the ceiling or any other above ground level location sufficiently outwardly of the lower lifting unit 36 so that a tensioning of the cables or ropes would cause the sets of panels to move outwardly from the center of lower lifting unit 36, i.e. outwardly from where panels 12*d* and 12*e* meet. A further alternative would be to dispose the cables horizontally at ground level and pull outwardly. The cables could be detached after panels 12 are horizontally deployed. The use of cables or ropes with the end panels 12*a*,12*h* should not result in a lifting of the end panels and should not cause the end and/or intermediate panels to assume any condition other than a horizontal condition.

In the embodiment illustrated, for example, in FIG. 1 each mechanism 20 includes a total of 8 panels. It is to be understood that the invention may be practiced with other numbers of rows and other numbers of panels.

As can be appreciated by having the appropriate number of mechanisms 20 and by customizing the number of panels in each mechanism to the specific size and shape of the rink it is possible to provide an effective covering system for virtually any size and shape of rink.

In its broad aspect the system of the invention thus includes an upper lift assembly which has at least one motion transmitting member. Preferably there are two such members in the form of chains 32,34. A drive mechanism, such as motor 22 and its associated gears/sprockets moves the transmitting members up and down. The motion transmitting members are connected to a lower lift unit 36 to raise and lower the lower lift unit. The lower lift unit includes connecting members such as chains 32,34 and ropes 42 secured to the panels to raise and to deploy the panels.

It is to be understood that the invention may be practiced with a number of different variations. For example, once the system is in its closed or compact position, such as shown in FIGS. 5–6, the entire system may be moved, such as by being on a track to a location completely away from the rink to minimize any interference with use of the rink. It is also to be understood that features shown with one lift assembly may be used with the other lift assembly and that the specific arrangement and description of, for example, sprockets, chains and gears is merely exemplary.

It is to be understood that although the invention has been particularly described with respect to covering an ice rink the various structures disclosed herein may be used for other purposes. For example, the invention may be used to cover a swimming pool or any other area it would be necessary or desirable to cover. For covering areas other than ice rinks the panels need not be insulation members but could be customized for their end purpose such as to maintain moisture conditions or to simply provide a cover for an area.

What is claimed is:

1. A covering system comprising an upper lift assembly including at least one motion transmitting member, a drive mechanism in said upper lift assembly for selectively moving said motion transmitting member up and down, a lower lift unit connected to said upper lift assembly by said motion transmitting member to move said lower lift unit selectively up and down in accordance with the direction of movement of said motion transmitting member, a panel assembly comprising a plurality of panels connected to each other along their adjacent sides, connecting members extending from said lower lift unit to said panels to raise and lower said panels and to dispose said panels in a horizontal orientation when said panels are in their lowermost position with said panels being disposed toward in each other in side edge to side edge fashion and to dispose said panels in a generally vertical orientation when said panels are in a raised position with said panels being in an accordion orientation disposed toward each other in surface to surface fashion, said covering system being in combination with an ice rink, and said covering system selectively covering said ice rink.

2. The system of claim 1 wherein said at least one motion transmitting member comprises two said motion transmitting members, and each of said motion transmitting members being anchored to said panels at locations spaced from each other whereby said motion transmitting members comprises two of said connecting members.

3. The system of claim 1 in combination with a plurality of said systems to comprise a combined covering system.

4. A covering system comprising an upper lift assembly including at least one motion transmitting member, a drive mechanism in said upper lift assembly for selectively moving said motion transmitting member up and down, a lower lift unit connected to said upper lift assembly by said motion transmitting member to move said lower lift unit selectively up and down in accordance with the direction of movement of said motion transmitting member, a panel assembly comprising a plurality of panels connected to each other along their adjacent sides, connecting members extending from said lower lift unit to said panels to raise and lower said panels and to dispose said panels in a horizontal orientation when said panels are in their lowermost position with said panels being disposed toward in each other in side edge to side edge fashion and to dispose said panels in a generally vertical orientation when said panels are in a raised position with said panels being in an accordion orientation disposed toward each other in surface to surface fashion, said at least one motion transmitting member comprises two said motion transmitting members, each of said motion transmitting members being anchored to said panels at locations spaced from each other whereby said motion transmitting members comprises two of said connecting members, each of said panels being connected to its adjacent said panel by a hinge mechanism, and each of said motion transmitting members being connected to the set of two end panels at said hinge mechanism of said end panels.

5. The system of claim 4 wherein said drive mechanism includes a reversible motor and a pair of sprockets, and said motion transmitting members comprising chains movably engaged with said sprockets.

6. The system of claim 5 wherein said lower lift unit includes a pair of pocket wheels freely rotatably mounted on shafts in said lower lift unit, and each of said chains engaged with a respective one of said pocket wheels.

7. The system of claim 6 wherein said lower lift unit includes a brake assembly mounted at each of said pocket wheels for applying a braking action to said pocket wheel to prevent the free spinning of said pocket wheel during the raising motion of said lower lift unit.

8. The system of claim 7 wherein said connecting members other than said chains comprises a plurality of ropes mounted to said lower lift unit, and an end of each of said ropes being anchored to a set of said panels at said hinge mechanism.

9. The system of claim 8 wherein said upper lift assembly includes a guide roller located at each of said sprockets to maintain said chain in engagement with said sprocket, and a guide chute at each of said sprockets to direct said chains out of and into said upper lift assembly.

10. The system of claim 8 wherein said lower lift unit includes guide members to maintain said chains engaged with said pocket wheels, and said chains being anchored to said hinge mechanisms by each of said chains being secured to a rope which is mounted to said hinge mechanism.

11. The system of claim 8 including a cable mounted to the endmost of each of said panels to pull said panels outwardly away from each other and facilitate said panels being disposed in said horizontal orientation.

12. The system of claim 11 including a weight mounted to said cable at the location where said cable is mounted to said panel.

13. The system of claim 8 in combination with a plurality of said systems to comprise a combined covering system.

14. The system of claim 13 in combination with an ice rink, and said covering system selectively covering said ice rink.

15. The system of claim 8 wherein said panel assembly comprises eight said panels.

16. The system of claim 8 including a remote control unit for controlling the operation of said drive mechanism.

17. The system of claim 8 wherein each of said hinge mechanisms is located along the side edges of adjacent said panels, each of said panels being made of an insulation material, and a plurality of straps wrapped around each of said panels and around said hinge mechanism to mount said panels to each other.

18. The system of claim 17 wherein each of said panels includes a recess along its said side edge to accommodate said hinge mechanism.

19. The system of claim 5 wherein said reversible motor is a first motor, a redundant reversible motor being selectively operable for said drive mechanism when said first reversible motor is inactive, and a collection bin mounted at each of said sprockets for collecting portions of said chains.

20. A covering system comprising an upper lift hoist assembly, a plurality of motion transmitting members, a drive mechanism to move said plurality of motion transmitting members, a panel assembly having a plurality of panels including two end panels and at least two intermediate panels, each of said end panels having a respective one of said motion transmitting members secured to said end panels, an intermediate assembly, and said motion transmission members extending from said upper lift hoist assembly to said plurality of panels by passing through said intermediate assembly whereby said intermediate assembly controls the direction of movement of said motion transmitting members to selectively dispose said plurality of said panels in generally surface to surface contact when said plurality of said panels is raised by said upper lift hoist assembly and to dispose said plurality of said panels in generally edge to edge relationship when said plurality of said panels is lowered to a covering position by said upper lift hoist assembly.

21. The system of claim 20 in combination with a plurality of said systems to comprise a combined covering system.

22. The system of claim 20 in combination with an ice rink and said covering system selectively covering said ice rink.

23. The system of claim 20 wherein each of said panels is connected to its adjacent said panel by a hinge mechanism, each of said motion transmitting members being connected to the set of two end panels at said hinge mechanism of said end panels, and said panels being made of insulation material.

24. The system of claim 23 wherein each of said hinge mechanisms is located along the side edges of adjacent said panels, each of said panels being made of an insulation material, and a plurality of straps wrapped around each of said panels and around said hinge mechanism to mount said panels to each other.

25. The system of claim 20 wherein said panel assembly comprises eight panels.

26. The system of claim 20 including a remote control unit for controlling the operation of said drive mechanism.

27. The system of claim 20 wherein a positioning cable is mounted to an outermost edge of each of said end panels to facilitate the spreading of said panels when said panels are lowered to a generally horizontal position.

28. The system of claim 27 in combination with an ice rink, and said covering system selectively covering said ice rink.

29. A method of selectively covering an ice rink comprising providing a plurality of insulated panels hinged together by a hinge mechanism between each adjacent pairs of panels, mounting a chain to the hinge mechanism at each end pair of said panels with the chain extending from an upper lift assembly and through a lower lift unit and then to the panels, mounting connecting members to alternate said hinge mechanisms of intermediate said panels with portions of the connecting members being in the lower lift unit, moving the chains and lower lift unit in a downward direction while the panels are elevated in an accordion orientation in side by side relationship, continuing the downward movement of the panels and lower lift unit until the panels contact the surface of the ice rink with the panels being permitted to assume a horizontal edge to edge orientation which covers at least a portion of the ice rink, raising the panels by moving the chains in an upward directed through the lower lift unit until the panels are raised above the ice rink surface and are in a side by side accordion orientation, and repeating the raising and lowering of the chains in accordance with the covering and uncovering of the ice rink.

* * * * *